US005135682A

United States Patent [19]

Cohen et al.

[11] Patent Number: 5,135,682

[45] Date of Patent: Aug. 4, 1992

[54] STABLE SOLUTIONS OF POLYANILINE AND SHAPED ARTICLES THEREFROM

[75] Inventors: Jeffrey D. Cohen, Hockessin; Raymond F. Tietz, Wilmington, both of Del.

[73] Assignee: E. I. du Pont de Nemours and Company, Wilmington, Del.

[21] Appl. No.: 497,218

[22] Filed: Mar. 15, 1990

[51] Int. Cl.[5] ..... H01B 1/00; H01B 1/06

[52] U.S. Cl. ..... 252/500; 252/364; 252/518; 106/311; 524/99; 524/186; 524/236; 528/422

[58] Field of Search ..... 252/500, 518, 364; 524/186, 99, 236; 528/422; 106/311

[56] References Cited

U.S. PATENT DOCUMENTS

| | | | |
|---|---|---|---|
| 4,615,829 | 10/1986 | Samura et al. | 252/500 |
| 4,762,644 | 8/1988 | Kobayashi et al. | 252/500 |
| 4,983,322 | 1/1991 | Eisenbaumer | 528/422 |

OTHER PUBLICATIONS

Synthetic Metals 24 (1988), pp. 231–238 and 255–265.
Synthetic Metals 26 (1988), pp. 383–389.
Synthetic Metals 30 (1989), pp. 199–207.
Bull. Am. Phys. Soc., vol. 34, No. 3 (1989), pp. 583–584.

*Primary Examiner*—William R. Dixon, Jr.
*Assistant Examiner*—Anthony J. Green

[57] ABSTRACT

Polyaniline fibers are spun from stable solutions of the polymer in certain amine solvents.

1 Claim, No Drawings

STABLE SOLUTIONS OF POLYANILINE AND SHAPED ARTICLES THEREFROM

BACKGROUND OF INVENTION

Polyaniline has relatively high thermal and chemical stability. In the doped form, it is electrically conductive and for certain applications this property is particularly desirable. Even in the base or non-conductive form, polyaniline would be more useful if it could be processed into shaped articles such as fibers. Unfortunately, fiber obtained by spinning polyaniline from acid solution is weak. Polyaniline appears to be insoluble or unstable in common non-acid media. The instability is such that the solutions at commercially useful concentrations cannot be spun through spinneret orifices because they gel too rapidly or form particulate material. The present invention provides stable solutions of base or doped polyaniline which can be spun through a spinneret and drawn into high strength polyaniline base filaments, and if desired, these filaments can be acid doped to impart electrical conductivity.

SUMMARY OF THE INVENTION

This invention provides stable spinning solutions of from about 10 to 30% by weight of polyaniline in a solvent selected from the group consisting of 1,4-diaminocyclohexane, 1,5 diazabicyclo (4.3.0) non-5-ene and a mixture of N-methyl pyrrolidone (NMP) with either pyrrolidine or ammonia. In the latter case, the polyaniline is combined with NMP in the indicated proportion and pyrrolidine or ammonia is added in an amount sufficient to dissolve the polyaniline. The solution is spun through a spinneret, optionally through an inert fluid, preferably air, and into a liquid that removes sufficient solvent from the extrudate to cause coagulation. This process and the resulting fibers are also part of this invention.

DETAILED DESCRIPTION OF THE INVENTION

Polyaniline and its production are well-known in the art.

As a general procedure for preparing stable solutions suitable for spinning, base polyaniline or doped polyaniline is mixed with the solvent in the desired proportions in a container. The content of polymer should be from 10 to 30% by weight. High concentrations are preferred not only because of economics i.e. increased throughput, less solvent to dispose of etc., but also because higher tenacities can be expected. As will be understood by those skilled in the art, the nature of the solvent and polymer, the viscosity of the solution and the spin temperature will dictate the optimum concentration. Excessive mixing and particularly high shearing should be avoided because undesirable increases in viscosity are frequently observed. In some instances it is desirable to maintain a protective atmosphere above the material in the mixing device.

The polyanilines employed in the present invention have intrinsic viscosities as measured in concentrated sulfuric acid of at least 1.0.

The use of 1,4-diaminocyclohexane or 1,5-diazabicyclo (4.3.0) non-5-ene as solvents for the polyaniline has been shown to give smooth spinnable solutions at a variety of concentrations and having viscosities suitable for spinning. The solutions have remained stable (no signs of gelling) for lengthy periods which would permit commercial spinning operations. The use of NMP at concentrations which give viscosities suitable for spinning has shown it to be a non-solvent or in most instances to yield solutions which gel. The spinning of consistently uniform products from gels or from particulate-containing solutions is difficult if not impossible. It has been found that addition of pyrrolidine or ammonia to the NMP results in smooth stable spinning solutions, see Examples 5 and 8 below.

The stable solutions are extruded through holes of a spinneret. Conventionally, a filter pack will precede a spinneret plate having a plurality of holes. Upon exiting the holes, the filaments are coagulated by immediate introduction into a coagulating bath such as water or the filaments may first traverse a gap of inert fluid, preferably air, before introduction into the bath. The filaments are withdrawn from the spinneret at a spin stretch factor which is adequate to maintain continuity of spinning as is well known in the art.

The as-spun fibers resulting from the spinning process will generally be drawn to increase tenacity.

Test Procedures

The following procedure is used to determine whether the polyaniline solutions are stable for spinning.

Solutions containing 20 wt. % of polymer are prepared by blending polyaniline base with the solvent in a glass beaker and stirring under full vacuum at from 15 to 25 rpm. using a 44 mm diameter, three-bladed impeller. Mixing is continued for at least 20 minutes. Suitable stable solutions are smooth and homogeneous after the mixing and can be spun from a spinneret through a layer of inert fluid into a coagulating bath to form a filament which can be drawn.

Electrical Conductivity is measured as follows:

The specimen of fiber to be tested is about 1.5 cm long. An electrical resistance measurement is carried out by a four probe method. Room temperature curing silver paste is used for the four electrodes. The two inner voltage measuring electrodes are 5 mm apart. The test specimen is contained in a sample cell which can be purged with gas continuously for determination of resistances under different environmental conditions. Current is applied to the two outer electrodes and the voltage corresponding to the known current is determined with an electrometer. Resistance is calculated based on Ohm's law. Conductivity in S/cm is calculated by normalization based on fiber cross-section and the distance between the voltage leads. S corresponds to Siemens.

Tenacity/Elongation/Modulus (T/E/Mi) are reported in gram per denier for T and Mi and in % for E.

The following examples are illustrative of the present invention.

EXAMPLE 1

The following procedure is employed to prepare the polymer.

The following components are placed into a jacketed, two-liter glass reaction vessel:

| | |
|---|---|
| aniline | 134.24 grams |
| aqueous hydrochloric acid solution (37.8%) | 194.34 grams |
| deionized water | 1350.40 grams |

The vessel is continuously stirred at about 120 rpm using a twin-bladed, 3 inch diameter impeller. A coolant fluid is circulated through the reactor jacket, supplied by a chilling unit set at −8° C. The reactor is covered and the head space is continually swept with a nitrogen gas stream.

An aqueous solution of oxidant is slowly added to the reaction medium. It is composed of:

| | |
|---|---|
| ammonium persulfate | 154.85 grams |
| deionized water | 269.70 grams |

The oxidant solution is metered using a syringe pump set to a delivery rate of 1.94 ml/min. Following the addition of oxidant solution, the reaction liquid is continually stirred and chilled (at the original settings) for about 2.5 days.

The reactor contents are then separated using a Buchner funnel. The recovered polymer solids are rinsed by passing about 25 liters of deionized water through the mass.

The polymer (currently in the doped, salt-form) is converted to the base form by stirring the powder with about 1 to 1.5 liters of 0.15 molar aqueous ammonium hydroxide solution for about 24 hours. The solids are then filtered from the liquid and again immersed in fresh 0.15 molar aqueous ammonium hydroxide solution for about 24 hours. The polymer is filtered from the liquid and dried in a partial vacuum until constant weight was reached.

Polymer analysis obtained as the average of two determinations was as follows: C, 74.50%; H, 5.56%; O, 4.06%; N, 15.21%; Cl, 0.22%; S, 0.08%. (The presence of oxygen at this level might be attributed to residual water.) The polymer had an intrinsic viscosity measured in 1,4-diamino-cyclohexane of 0.24.

A 16% solution was made by adding 0.57 g of polyaniline base to 2.94 g of 1,4-diaminocyclohexane and stirring. Fibers were spun from this solution by extruding it from a syringe through a 2.5 cm air layer into water. The fibers were soaked in water for 12 hr and then dried in a 45° C. vacuum oven.

EXAMPLE 2

The following ingredients were placed in a 150 cc twin helical bladed mixer (Atlantic Co.):

20 g polyaniline base (same as in Example 1)

80 g 1,4-diaminocyclohexane

Mixing was carried out for one hour under an atmosphere of nitrogen and then for 30 minutes under an atmosphere of ammonia gas. The resulting deep blue viscous solution was transferred to a spinning cell and wet spun into water through a 10 (0.005") hole spinneret and a 10 (0.010") hole spinneret. After soaking in water for 12 to 24 hours, followed by drying in air, the fibers were drawn 2× over a 214° C. hot pin. They had a coppery luster and were found to be infusible when placed on a hot bar at 400° C. A one-inch gauge length sample of this fiber tested at 65% R.H. with an elongation rate of 10%/min. gave a maximum T/E/-Mi=3.0/8.1/79.

An attempt to repeat the solution preparation described above, using a 4 hr mixing time, resulted in semisolid pellets of material which did not flow. The estimated shear rate to which this solution was exposed in the Atlantic mixer was about 25 $sec^{-1}$.

The "as-spun" undoped polyaniline fibers were immersed (without tension) in an aqueous solution of 4.9 g $H_2SO_4$ in 45.1 g deionized water for 20.5 hours. The fibers were then air-dried for about five days before applying silver paste electrodes for the electrical resistance measurement. Electrical conductivity of one of the fibers at ambient conditions was measured as 86.8 S/cm. The conductivity dropped to 18.8 $/cm after continuous purging with dry nitrogen (moisture removal) for 20.5 hours, but increased to 84.0 S/cm after being exposed to ambient conditions.

The 2x drawn and oriented, updoped polyaniline fibers were immersed in an aqueous solution of 4.98 g $H_2SO_4$ in 45.1 g deionized water for 46 hours. Electrical conductivity of one of the air dried fibers at ambient conditions was 172.5 S/cm. The conductivity dropped to 61.1 S/cm after continuous purging with dry nitrogen for 13 hours.

EXAMPLE 3

3.0 g of polyaniline (same as in Example 1) and 12.0 g of 1,4-diaminooyclohexane were placed in a beaker equipped with an air-driven stirrer and the combination was enclosed in a bell jar. The mixture was stirred for two hours at a very slow impeller speed (about 15 rpm with a 44 mm diameter 3-bladed stirrer with a gap of about 1.5 mm between the surface of the beaker and the blades). The result was a smooth viscous solution. When the stirrer speed was increased to about 50 to 70 rpm, however, the solution quickly became lumpy. Resumption of slow stirring reformed the smooth viscous solution. This behavior indicates the sensitivity of these solutions to the shear imposed on them.

The above smooth solution was transferred to a stainless steel spinning cell which had a spinneret with a 0.004" diameter (L/D=2) hole. Above the spinneret was a 200 mesh screen filter. The solution was spun through an 8 mm air gap into a 20 cm long water bath for about three hours at a delivery rate of 0.05 cc/min (Jet velocity =6.0 m/min) and a windup speed of 8.3 m/min without clogging or plugging. One of the bobbins of fiber collected was soaked in water for 24 hrs and a sample of this fiber was drawn about 2 × over a 215° C. hot pin.

EXAMPLE 4

Three (3.0) grams of undoped polyaniline powder (prepared in a manner similar to the procedure of Example 1) were blended with 12.0 grams of 1,4-diaminocyclohexane in a 100 ml beaker with mixer in a bell jar as described in Example 3, under a 20 mm Hg vacuum for 2 hours. The polymer had an intrinsic viscosity measured in concentrated sulfuric acid of 1.31 and on analysis contained—C, 76.71%; H, 5.39%; O, 3.20%; Cl, 0.34%; S, 0 06%. The mixing speed was 20 RPM using a 44 millimeter diameter, three-bladed impeller. The solution was transferred under vacuum into a stainless steel spin cell, passed through a 325 mesh screen filter and spun from a single-hole (0.004" dia., 2/1 L/D) spinneret through an air gap (2 mm) into tap water. (Note: This spinneret had the same dimensions as that used to produce the fiber of Example 3 but the bore surface was polished instead of having the roughly machined surface present in the Example 3 spinneret. The fiber path-length in the coagulant bath was 10 inches. The entire process was run at room temperature. The monofilament was collected at 2.42 m/min on a motor-driven spool.

After spinning, the collected bobbins of fiber were placed in tap water for 24 hours at room temperature then dried in air. These as-spun fibers were manually drawn 2–3× over a hot pin in air at 215° C. Tensile breaks (7) were run at a 1" gage length and a 65% relative humidity. The average (denier) T/E/Mi—(6.3) 3.9/9.3/8.3 with a single break maximum of 5.0 gpd.

The 2–3× drawn and oriented, undoped polyaniline fibers were immersed (without tension) in an dilute aqueous $H_2SO_4$ solution (10.21 g 96.6% $H_2SO_4$ and 89.94 g deionized water) for 24.5 hours. The doped fibers were washed with water briefly and then dried in ambient air for two days. Electrical conductivity measured at ambient conditions on one of the fibers was 20.5 S/cm.

Other 2–3× drawn and oriented, undoped polyaniline fibers were immersed for 24.5 hours in a solution made by adding 10.08 g of concentrated HCl (35.5 to 38 wt %) to 89.98 g deionized water. The fibers were air-dried for about 6 days before the silver paste electrodes were attached. Electrical conductivity at ambient conditions was 157.8 $/cm. Average T/E/M (1" gauge length, eight breaks) of the fibers were 1.35/18/44.

EXAMPLE 5

1.00 g of polyaniline base was prepared according to the procedure in "Polyaniline: Synthesis and Characterization of the Emeraldine Oxidation State by Elemental Analysis", *Conducting Polymers*, Raidel Publ., Dordrecht, Holland, p. 105 (1987), A. G. Mac Diarmid, J. C. Chiang, A. F. Richter, N. L. D. Somasiri and A. J. Epstein. It was extracted first with tetrahydrofuran and then with NMP then doped with aqueous HCl and undoped with aqueous $NH_4OH$ solution. The polymer, 5.00 g of NMP, and 3.00 g of pyrrolidine were placed in a covered beaker and heated on a hot plate. The mixture became viscous but as the pyrrolidine evaporated the mixture solidified. Addition of pyrrolidine reformed the viscous solution. The polymer solution was placed in a syringe, extruded through a 20 gauge needle and the extrudate collected on a polytetrafluoroethylene coated card. After three days exposure to the atmosphere, the extrudate became a flexible ribbon-like fiber. When the solution was extruded into a solution of water and ammonium hydroxide (about 10/1 by weight) the resulting fiber was much weaker.

EXAMPLE 6

HCl-doped polyaniline was made as follows: 20 ml aniline (Baker #9110-01) was added to 300 ml of ice-water chilled 0.97 molar aqueous HCl solution. This aniline solution was cooled in an ice-water bath while a chilled solution of 11.5 g of ammonium persulfate (Baker #07621-01) in 200 ml 0.97 M aqueous HCl solution was added. The addition took about five minutes. The reaction was allowed to proceed for two hours at about 3° C. Four batches were made in the same manner and filtered separately on a Buchner funnel. Each filter cake was washed with 500 ml 0.97 M HCl solution. The four filter cakes were combined, slurried with about 700 ml 1 M HCI solution and filtered again. The salt was dried in a vacuum oven at room temperature with nitrogen purging.

The dried HCl-doped polyaniline was slowly added to 4.5 g of distilled 1,4-diaminocyclohexane contained in a glass vial. A solution with polymer concentration of 25 wt% was achieved. Filaments could be pulled easily from the 25% solution with a spatula.

EXAMPLE 7

3.0 g of the HCl doped polyaniline described in Example 6 was added slowly to a glass vial containing 9.0 g 1,5-diazabicyclo[4.3.0]non-5-ene. The mixing was carried out with a spatula while the mixture was blanketed with nitrogen. The polymer dissolved in the solvent easily and filaments could be pulled from the solution with the spatula. The solution viscosity appeared unchanged after 12 hours. It was transferred to a plastic syringe packed with 100/200/100 mesh filtration screens and injected into a spinning cell held under vacuum to limit bubble formation. The cell had a spinneret with a single 4 mil diameter 8 mil long hole fitted with a 325 mesh screen filter. The polymer was spun into a water bath with the spinneret face about ¼" above the water surface. Fiber was wound up at 12 ft/min. Bobbins of as spun fiber were soaked in water for 18 hours then dried. The fibers were drawn 3 to 4× on a 200° C. hot pin. The tensile properties were determined from an average of seven 1" filament breaks—T/E/M=2.3/8.4/59.

EXAMPLE 8

An air driven stirrer was placed in a beaker and the combination enclosed in a bell jar. 1.08 g of polyaniline base prepared in a manner similar to Example 1 and 9.72 g of NMP were placed in the beaker. When stirred the mixture appeared to be more of a suspension than a solution. As soon as ammonia gas was piped into the bell jar, the polymer began to dissolve rapidly. After 20 minutes the viscosity of the solution still appeared to be relatively low so additional amounts of polyaniline base were added in portions until a final concentration of 17% was attained. At this stage the solution was viscous and films having good integrity were cast from the solution.

We claim:

1. A stable spinning solution consisting essentially of from about 10 to 30% by weight of polyaniline in a solvent selected from the group consisting of 1,4-diaminocyclohexane, 1,5-diazabicyclo[4.3.0 non-5-ene, and a mixture of N-methylpyrrolidone with either pyrrolidine or ammonia in an amount sufficient to dissolve the polyaniline

* * * * *